US005168903A

United States Patent [19]

Suwa

[11] Patent Number: 5,168,903

[45] Date of Patent: Dec. 8, 1992

[54] CONTROL OF WEFT FEEDING SPEED FOR SUPPLY OF A FIXED PICK LENGTH TO AN INSERTION NOZZLE

[75] Inventor: Mitsuru Suwa, Kanazawa, Japan

[73] Assignee: Tsudakoma Kogyo Kabushiki Kaisha, Kanazawa, Japan

[21] Appl. No.: 758,124

[22] Filed: Sep. 12, 1991

[30] Foreign Application Priority Data

Sep. 20, 1990 [JP] Japan ..... 2-253422

[51] Int. Cl.[5] ..... D03D 47/36

[52] U.S. Cl. ..... 139/452

[58] Field of Search ..... 139/452; 242/47.01

[56] References Cited

U.S. PATENT DOCUMENTS 4,716,943 1/1988 Yoshida et al. ..... 139/452

4,936,356 6/1990 Ghiardo ..... 139/452

FOREIGN PATENT DOCUMENTS 61-27500 6/1986 Japan .

*Primary Examiner*—Andrew M. Falik

*Attorney, Agent, or Firm*—Oblon, Spivak, McClelland, Maier & Neustadt

[57] ABSTRACT

A weft insertion controlling method for a multi-color shuttleless weaving machine wherein weft insertion is performed using a drum type length measuring reserving apparatus. The drum is driven at various speeds for individual weft insertion cycles of one repetition of a weaving pattern so that the weft insertion controlling method can accommodate any weft insertion condition while the location of the restraining pin for engaging with a yarn on the drum is left fixed.

4 Claims, 9 Drawing Sheets

CONTROL OF WEFT FEEDING SPEED FOR SUPPLY OF A FIXED PICK LENGTH TO AN INSERTION NOZZLE

BACKGROUND OF THE INVENTION

1. Field of the Invention

This invention relates to a weft insertion controlling method for a shuttleless weaving machine which can cope appropriately with a variation in weft insertion condition when weft insertion is performed using a drum-type length measuring reserving apparatus in an arbitrary weft insertion pattern, for example in 2×2 weft insertion pattern or in 2×1 weft insertion pattern.

2. Discussion of the Background

Technique of performing the above mentioned multi-color weft insertion on a shuttleless weaving machine using a drum-type length measuring reserving apparatus (hereinafter referred to merely as length measuring apparatus) is known, for example, by Japanese Patent Publication Application No. 61-27500.

According to the technique, length measuring apparatus are used which include a drum, a positive yarn supply mechanism such as a delivery roller for supplying a yarn to the drum at the same yarn speed as a circumferential speed of the drum, and a restraining pin adapted to be engaged with or disengaged from a yarn on the drum to control an amount of the yarn reserved on the drum. In particular, while each of the weft yarns is continuously fed to its corresponding drum at regular speed, a repeat of a weaving cycle or cycles wherein a certain weft yarn is inserted into a warp shed (hereinafter referred to as weft insertion cycle) and another weaving cycle or cycles wherein another weft yarn is inserted (hereinafter referred to as weft non-insertion cycle) is performed to realize multi-color weft inserting operation in accordance with a predetermined weft insertion pattern.

A weft inserting operation in such a weft insertion cycle as mentioned above is performed using a weft inserting member such as a weft inserting nozzle and includes a combination of (1) a free flying condition wherein a yarn reserved on the drum is weft inserted while being unwound freely from the drum and (2) a restrained flying condition wherein a yarn is inserted at such a speed that the positive yarn supply mechanism feeds a yarn to the drum without changing the reserved amount of the yarn on the drum. The latter is performed by engaging the restraining pin with a yarn on the drum to prevent the yarn from being unwound freely from the drum or by reducing the reserved amount of a yarn on the drum completely to zero and supplying a yarn directly from the positive yarn supply mechanism to the weft inserting member. It is to be noted that it is known that a dispersion of lengths of a weft inserted for various weft insertion cycles (each such length will be hereinafter referred to as one-pick length) can be minimized by setting a restrained flying condition to a section near an end point of each weft insertion cycle.

A 2×2 weft insertion pattern will be examined here wherein, as shown in FIG. 12, four weaving cycles are set as one repeat and two former weaving cycles are determined as weft non-insertion cycles while two latter weaving cycles are determined as weft insertion cycles.

If the one-pick length which is a unit defined by a circumferential length of the drum is $_{\Delta}n$ which is equal to $_{\Delta}n=6.5$ (turns), then the drum must be driven at an equal speed so that a yarn of $2_{\Delta}n-13.0$ (turns) may be reserved for one repeat. Since the former two weaving cycles are set as weft non-insertion cycles, the reserved amount N of a yarn on the drum increases linearly at a rate of 13/4=3.25 (turns/weaving cycle). Then, if a weft insertion section T is entered during the first weft insertion cycle (the third weaving cycle in the one repeat), then the reserved amount N decreases suddenly for a free flying condition section T1. Then in a restrained flying condition section T2, the reserved amount N does not vary while weft insertion is performed at a yarn speed which depends upon the circumferential speed of the drum. Thus, at the end point of the weft insertion section T, that is, at an end point of the weft insertion cycle, weft insertion of the predetermined one-pick length $_{\Delta}n=6.5$ (turns) comes to an end. A quite similar weft inserting operation is performed also in a succeeding weft insertion cycle (the fourth weaving cycle).

Here, the reserved amounts n1 and n0 at the end points of the weft insertion cycles are n1=3.25 (turns) and n0=0 (turn), respectively. Accordingly, at the end point of the first weft insertion cycle, an imaginary reserved amount N1 when it is presumed otherwise that weft insertion is not performed is provided by $N1=13\times\frac{3}{4}=9.75$ (turns), and $$n1=N1-_{\Delta}n=9.75-6.5=3.25 \text{ (turns)}$$

stands. On the other hand, at the end point of the last weft insertion cycle (the fourth weaving cycle in the one repeat), an imaginary reserved amount M0 when weft insertion only in the last weft insertion cycle is not performed is provided by $M0=N0-_{\Delta}n=13-6.5=6.5$ turns, and $$n0=M0-_{\Delta}n=6.5-6.5=0 \text{ (turn)}$$

stands where N0 is an imaginary reserved amount at the end point of the last weft insertion cycle when weft insertion is performed i·n neither of the two weft insertion cycles. After then, the predetermined weft insertion pattern is performed repetitively while driving the drum at the equal speed in a similar as described above.

It is to be noted that, in order to allow restrained flying in a condition wherein the reserved amount of a yarn on the drum is kept equal to N=n1=3.25 (turns), a restraining pin P is disposed at a location displaced by a distance equal to one fourth the circumferential length of the drum D in a circumferential direction from a point A of the drum D to which a yarn W is supplied as shown in FIG. 13(A), and a remaining amount n1=3.25 (turns) on the drum D should be realized. It is to be noted that a pair of delivery rollers R on the upstream side of the drum D are provided to supply a yarn W positively toward the drum D at a yarn speed equal to a circumferential speed of the drum D, and a pair of yarn guides G1 and G2 are disposed forwardly and rearwardly of the drum D. It is also to be noted that, in restrained flying of N=n1=0 (turn), a yarn W should be forwarded only by way of the delivery rollers R and the yarn guides G1 and G2 irrespectively of the drum D and the restraining pin P as shown in FIG. 13(B).

With such conventional technique as described above, if the weft insertion conditions such as a one-pick length for each weft insertion cycle and a number of weft insertion cycles in one repeat are varied, then the location of the restraining pin must necessarily be changed in a circumferential direction of the drum. Accordingly, in the conventional technique, the operation in working is very complicated.

For example, referring to FIG. 12, if the one-pick length $_{\Delta}n$ is changed from $_{\Delta}n=6.5$ to $_{\Delta}n=7.5$ (turns), then N0, N1, and n1 would be changed as follows:

$$N0=2\times 7.5=15.0$$

$$N1=15\times\tfrac{3}{4}=11.25$$

$$n1=11.25-7.5=3.75$$

Accordingly, restrained flying at the end point of the first weft insertion cycle must involve a remaining amount of n1=3.75 (turns) on the drum, and to this end, the restraining pin P must necessarily be moved 180° from that shown in FIG. 13(A) to dispose the same at a location displaced by a distance equal to three fourths, rather than one fourth the circumferential length of the drum D in a circumferential direction from the point A at which the yarn W is supplied.

SUMMARY OF THE INVENTION

Accordingly, it is a principal object of the present invention to provide a weft insertion controlling method for a shuttleless weaving machine which can cope with any change of weft inserting conditions while a location of a restraining pin is kept fixed with respect to a drum.

So, in the present invention, a drum is driven at various speeds for individual weft inserting cycles instead of regular speed driving throughout the entire weaving pattern.

The drum speed is controlled so that an imaginary reserved amount at the end point of a weft insertion cycle may be equal to a value obtained by an addition of a length of a yarn weft inserted until the end point of the weft insertion cycle in the one repeat to an optimum reserved amount which depends upon a location of a restraining pin with respect to the drum. As a result a predetermined one-pick length can be assured without fail as a length of a weft inserted yarn in each weft inserting cycle. Thus, the weft insertion controlling method can cope with such condition change by changing the driving speed of the drum, and accordingly, the location of the restraining pin need not be changed. It is to be noted that, since such optimum reserved amount is a reserved amount upon restrained flying in the last weft insertion cycle, it can be determined to be equal to zero irrespectively of the location of the restraining pin, but if it has any other value than zero, a fraction of the value must correspond to the location of the restraining pin. However, even in the latter case, advantageously the range of variation of the speed of the drum has a reduced value, and accordingly, the optimum reserved amount preferably assumes a value proximate to a theoretical reserved amount when the drum is driven at an equal speed.

If the driving speed of the drum in the last weft insertion cycle is applied to another weft insertion cycle, then the yarn speed upon restrained flying in each weft insertion cycle can be made fixed, and consequently, the dispersion in tension of a yarn being weft inserted is reduced and the quality of a woven fabric can be improved.

Further, if a base reserved amount other than zero and having a fraction which depends upon the location of the restraining pin is set as a minimum reserved amount for one repeat, then the reserved amount on the drum is not reduced to zero even upon restrained flying in the last weft insertion cycle, and accordingly, a manner of restrained flying in all weft insertion cycles including the last weft insertion cycle can be performed by the restraining pin and the dispersion in tensile force of a yarn can be further reduced.

It is to be noted that, if a value proximate to a theoretical reserved value or equal to zero is employed as such optimum reserved amount, then the range of variation in speed of the drum can be reduced.

DESCRIPTION OF THE PREFERRED EMBODIMENTS

In the following, embodiments will be described with reference to the drawings.

Figure 1:
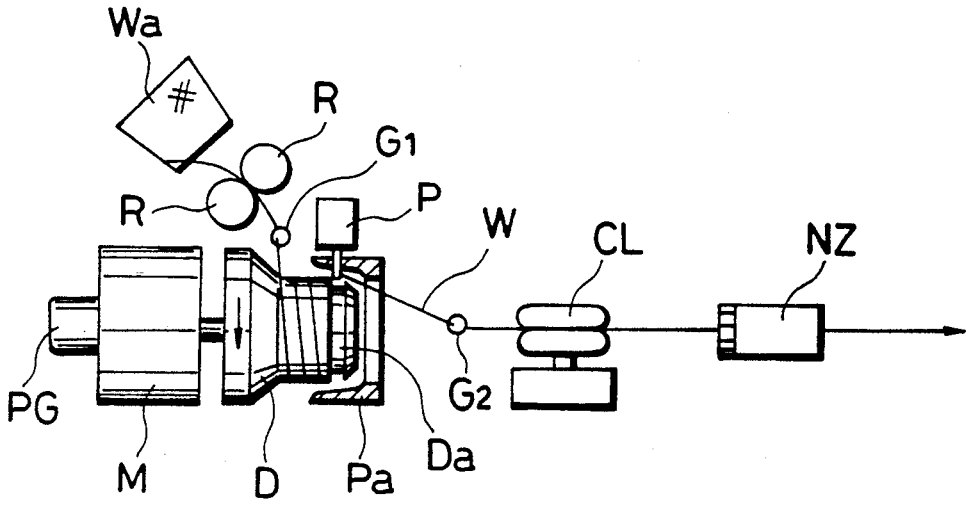
FIG. 1 is an illustrative view of an entire weft inserting apparatus to which the present invention is applied.

Weft insertion control of a shuttleless weaving machine is performed using a length measuring apparatus shown in FIG. 1. The length measuring apparatus is constituted from a feed motor M in the form of a variable speed motor, a drum D which is driven by the feed motor M, a restraining pin P, and a pair of delivery rollers R for supplying a yarn W from a yarn supply member Wa positively to the drum D.

Further, a pulse generator PG for detecting an amount of rotation of the drum D is connected to the feed motor M, and the restraining pin P is carried on a bracket Pa adjacent a front end of the drum D. The restraining pin P is advanced toward an annular recessed groove Da formed on the drum D, and when an end thereof is inserted into the recessed groove Da, it can be engaged with the yarn W on the drum D, but when it is retracted to remove the end thereof from the recessed groove Da, it can be disengaged from the yarn W.

After the yarn W is released from the yarn supply member Wa, it is supplied to a rear portion of the drum D via the delivery rollers R and the yarn guide G1 and wound around and reserved on the drum D. The yarn W on the drum D is released from a front portion of the drum D and weft inserted into a shedding of warps not shown via another yarn guide G2, a clamping apparatus CL and a weft inserting nozzle NZ.

The delivery rollers R are constructed such that they supply the yarn W from the yarn supply member Wa positively to the drum D at a yarn speed equal to a circumferential speed of the drum D, thereby forming a positive yarn supply mechanism. The restraining pin P, clamping apparatus CL and weft inserting nozzle NZ are controlled to operate at respective predetermined timings of a weaving cycle by a weft insertion controlling apparatus not shown to perform a weft inserting operation of the yarn W. In particular, the restraining pin P is retracted to be removed from the recessed groove Da of the drum D and then the weft inserting nozzle NZ is rendered operative, whereafter the clamping apparatus CL is opened, thereby to allow the yarn W reserved on the drum D to be weft inserted in a free flying condition. When the yarn W is restrained by the restraining pin P inserted into the recessed groove Da or when the reserved amount on the drum is zero, a restrained flying condition can be achieved.

Figure 2:
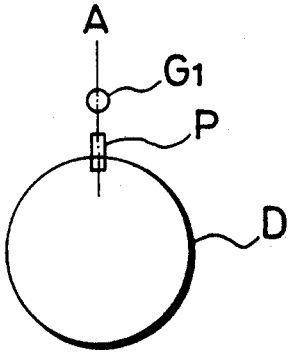
FIG. 2 is an illustrative view showing a location of a restraining pin in FIG. 1.

It is to be noted that, in the present example, the location of the restraining pin P is set with respect to a supplied point A of the yarn W which depends upon the yarn guide G1 such that they may be positioned at the same positions in a circumferential direction of the drum D as shown in FIG. 2.

Figure 3:
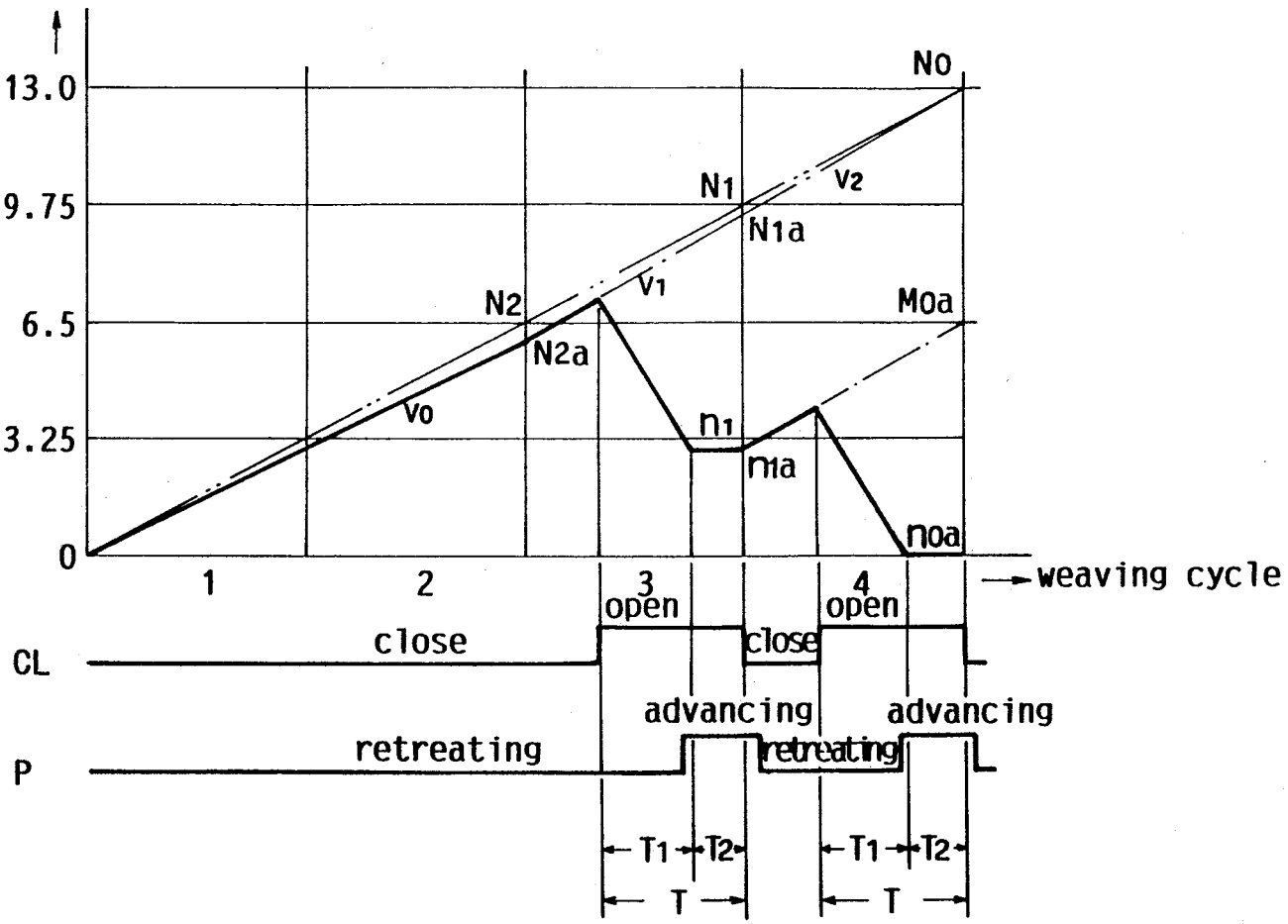
FIGS. 3 and 4 are graphs showing reserved amount curves according to the present invention.
Figure 4:
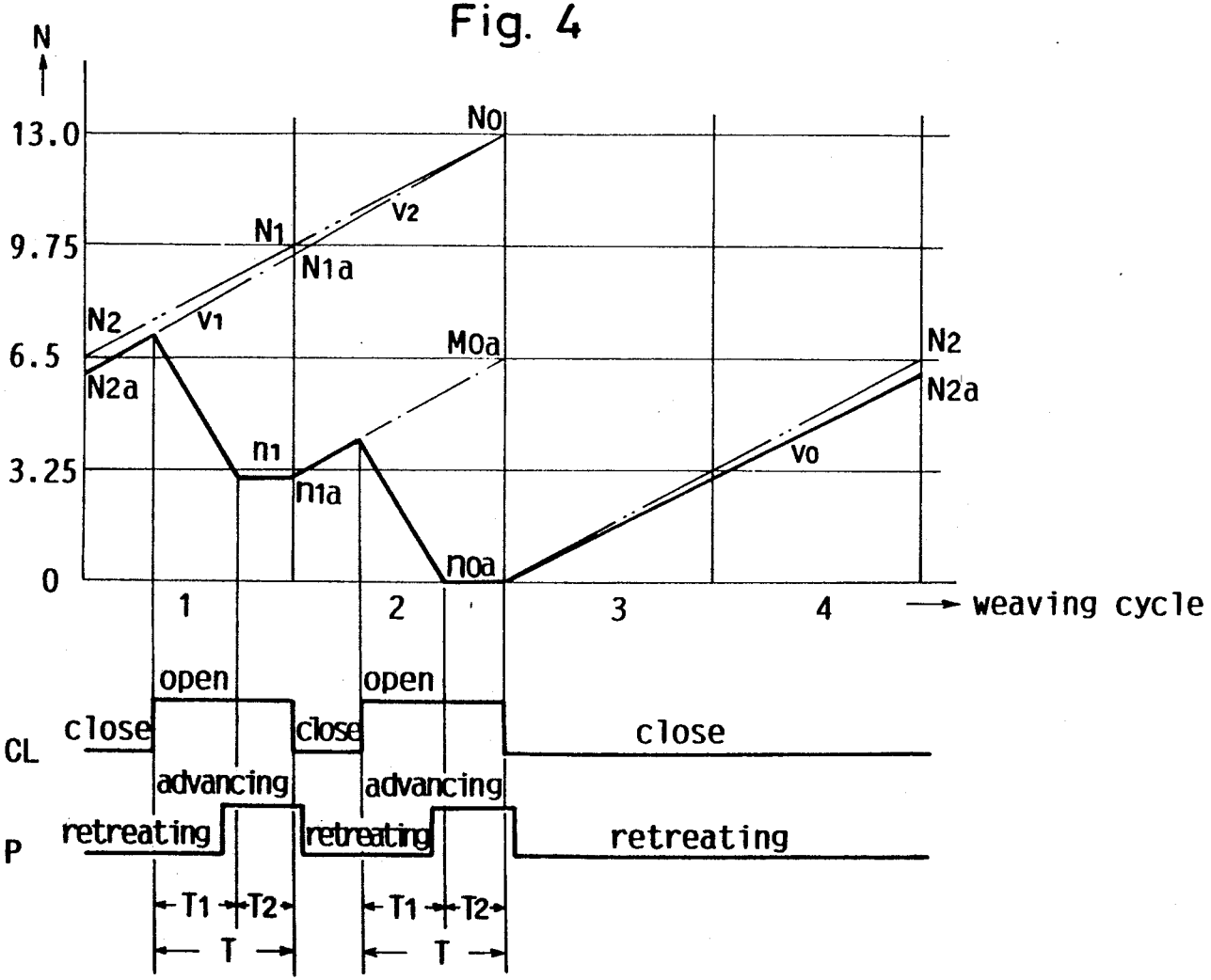

A case will be examined here wherein two length measuring apparatus of the construction described above are provided in a juxtaposed relationship and perform weft insertion in accordance with such 2×2 weft insertion pattern that the latter two weaving cycles in one repeat which consists of four weaving cycles are set as weft insertion cycles for one of such two length measuring apparatus while the former two weaving cycles in the one repeat are set as weft insertion cycles for the other length measuring apparatus. FIGS. 3 and 4 show reserved amount curves in such case.

If the one-pick length $_{\Delta}n$ in each weft insertion cycle is equal to $_{\Delta}n=6.5$ (turns), then the drum must supply a yarn W of $2_{\Delta}n=13.0$ (turns) in one repeat consisting of four weaving cycles, and accordingly, an imaginary reserved amount N0 at the end point of the last weft insertion cycle (the fourth weaving cycle in FIG. 3 or the second weaving cycle in FIG. 4) is equal to $N0=2_{\Delta}n=13.0$ (turns). Meanwhile, at the end point of the first weft insertion cycle (the third weaving cycle in FIG. 3 or the first weaving cycle in FIG. 4), that is, at the starting point of the last weft insertion cycle, an imaginary reserved amount N1 when the drums D are driven at an equal speed are equal to $N1=13\times\frac{3}{4}=9.75$ (turns) (alternate long and two short dashes lines in FIGS. 3 and 4), and accordingly, if the reserved amount to be assured on the drums D is defined as a theoretical reserved amount n1, then the theoretical reserved amount n1 is equal to $n1=N1-_{\Delta}n=9.75-6.5=3.25$ (turns).

However, since the restraining pin P and the yarn guide G1 are disposed at the same position in a circumferential direction of the drum D and accordingly restrained flying involving the theoretical reserved amount of n1=3.25 (turns) on the drum D cannot be realized, if, for example, an optimum reserved amount n1a=3.0 (turns) proximate to the theoretical reserved amount n1=3.25 (turns) is determined, then an imaginary reserved amount N1a in this instance can be determined as $N1a=n1a+_{\Delta}n=3.0+6.5=9.5$ (turns). Thus, the driving speed v2 of the drums D in the last weft insertion cycle can be determined, using the imaginary reserved amount N1a at the starting point and the imaginary reserved amount N0 at the end point of the last weft insertion cycle, as $v2=(N0-N1a)/t$ (turn/second), where t is a time (seconds) required for one weaving cycle.

The driving speed V1 of the drums D in the first weft insertion cycle can be determined in a similar manner.

In particular, first the imaginary reserved amount N1a at the end point is determined as N1a=9.5 (turns). Further, since it is known that, at the starting point, the theoretical reserved amount N2 when the drums D are driven at an equal speed is equal to $N2=13\times\frac{1}{2}=6.5$ (turns), if, for example, an optimum reserved amount N2a proximate to the theoretical reserved amount N2 is determined as N2a=6.0, then the driving speed v1 of the drums D can be determined as $v1=(N1a-N2a)/t$. Further, the driving speed v0 of the drums D in a weft non-insertion cycle may be determined as v0−N2a/(2t).

It is to be noted that, since N0=13.0, N1a=9.5 and N2a=6.0 in the present example, $v1=v2=3.5/t$ (turn/second). Further, at the end point of the last weft insertion cycle, the imaginary reserved amount M0a when weft insertion is not performed in the last weft insertion cycle is equal to $M0a=n1a+(N0-N1a)=N0-_{\Delta}n=13-6.5=6.5$ (turns), and consequently, at the end point of the last weft insertion cycle, restrained flying with an optimum reserved amount of $n0a=M0a-_{\Delta}n=6.5-6.5=0$ (turn) is performed.

In a weft insertion section T of each weft insertion cycle, first a free flying condition section T1 can be realized by rendering the weft inserting nozzle NZ operative and opening the clamping apparatus CL, and then a restrained flying condition section T2 can be realized by advancing the restraining pin P. However, in restrained flying in the last weft insertion cycle, since n0a=0 (turn), the yarn W then is forwarded via the delivery rollers R and the yarn guides G1 and G2 irrespectively of the drum D and the restraining pin P.

The value which can be assumed by the optimum reserved amount n1a at the end point of the first weft insertion cycle in the foregoing description depends upon the location of the restraining pin P. In particular, since the optimum reserved amount n1a is a reserved amount on the drum D upon restrained flying in the first weft insertion cycle, in case the location of the restraining pin P is at the same position as the yarn guide G1 in a circumferential direction of the drum D (FIG. 2), the fraction of the optimum reserved amount n1a must be equal to zero, but in case the restraining pin P is displaced by a distance equal to one fourth the circumferential length of the drum D from the yarn guide G1 (FIG. 5), the fraction of the optimum reserved amount n1a must be equal to 0.25 or 0.75 depending upon a winding direction of the yarn W. In case the restraining pin P is displaced by a distance equal to one half the circumferential length from the yarn guide G1 (FIG. 6), the fraction of the optimum reserved amount n1a is limited to 0.5. However, the optimum reserved amount n1a can be determined to be n1a=0 (turn) irrespectively of the location of the restraining pin P. This is because restrained flying with n1a=0 can be realized irrespectively of the restraining pin P.

It is to be noted that the delivery rollers R may be of any type selected arbitrarlly from among known types only if they can supply a yarn W to the drum D at a yarn speed equal to a circumferential speed of the drum D. For example, an arrangement can be listed wherein a single delivery roller R which contacts with a drum D is used such that a yarn W is gripped between the drum D and the delivery roller R to supply the same. Further, the positive yarn supply mechanism is not limited to that which is constituted from a roller or rollers but may be such that a pair of yarn guides are provided sidewardly of a drum in a spaced relationship in an axial direction of the drum D In particular, the positive yarn supply mechanism may be such that a yarn W from a yarn supply member Wa is introduced to a drum by way of a first yarn guide and wound by a fixed number of turns on a surface of the drum and then is wound again on the surface of the drum D by way of a second yarn guide. Accordingly, the yarn W succeeding to the second yarn guide makes a reserved amount on the drum D, and while the number of turns thereof wound around the drum D varies, the number of turns of the yarn W wound around the drum between the first and second yarn guides is invariable, and a frictional force to cause the yarn W from the yarn supply member Wa to be supplied to the drum D without a slip can be produced by rotation of the drum D. Further, a positive yarn supply mechanism of the so-called Nelson roller type can be made also by wrapping a yarn W commonly between and around a drum D and an auxiliary roller parallel to the drum D.

Figure 5:
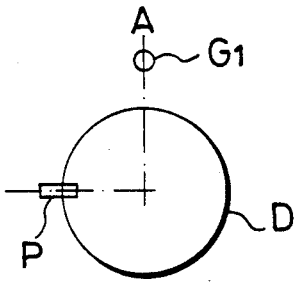
FIGS. 5 and 6 are illustrative views illustrating other locations of a restraining pin in an example of application of the present invention.
Figure 6:
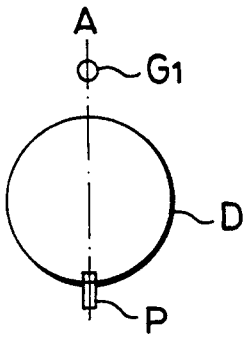
Figure 7:
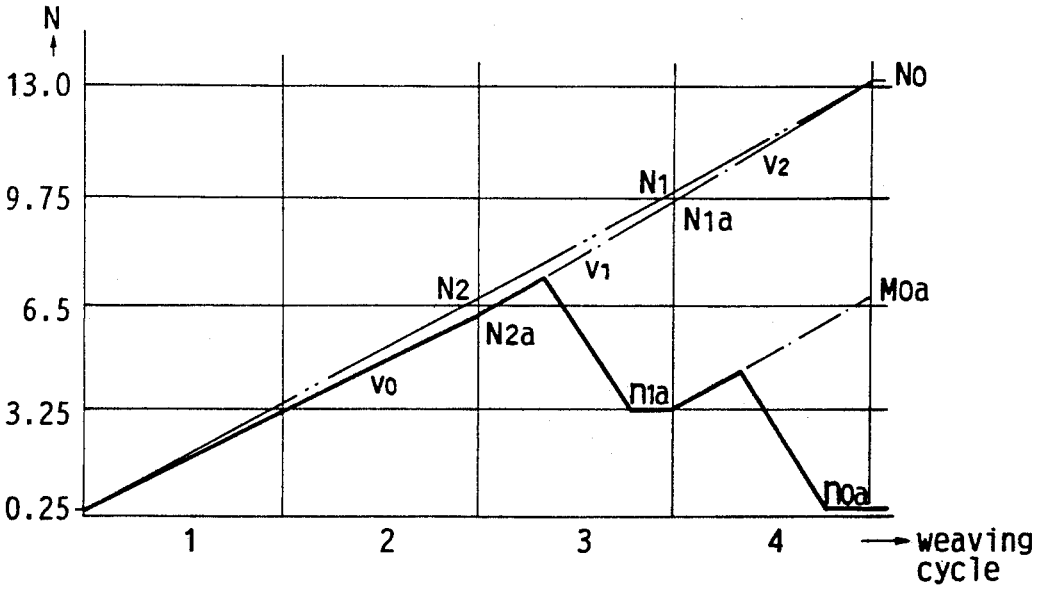
FIGS. 7, 8, 9(A), 9(B) and 10 are graphs showing reserved amount curves in another embodiment according to the present invention.

The optimum reserved amount n0*a* at the end point of the last weft insertion cycle in one repeat can be set to a base reserved amount other than 0 and having a fraction which depends upon the location of the restraining pin as shown in FIG. 7. In particular, the reserved amount at the end point of the last weft insertion cycle makes a minimum reserved amount in one repeat. Accordingly, to set a base reserved amount not equal to zero as such minimum reserved amount signifies that, even upon restrained flying in the last weft insertion cycle, a yarn W exists on the drum D, and accordingly, the yarn W is weft inserted not only after passing the delivery rollers R and the yarn guides G1 and G2 but passing, after it is reserved on the drum D by a number of turns corresponding to the base reserved amount from the yarn guide G1, the restricting pin P and the yarn guide G2. In particular, since restrained flying then has a substantially same manner as restrained flying in the first weft insertion cycle, the tensile force of the yarn W can be prevented positively from dispersing for different weft insertion cycles. It is to be noted that, when a base reserved amount of n0*a*=0.25 (turns) is to be set as shown in FIG. 7, the location of the restraining pin P should be disposed in a displaced relationship by a distance equal to one fourth the circumferential length of the drum D in a circumferential direction of the drum with respect to the yarn guide G1 as shown in FIG. 5. Reserved amount curves in this instance can be obtained only by shifting the reserved amount curves of FIGS. 3 and 4 upwardly in parallel by a distance corresponding to the base reserved amount, and accordingly, also the optimum reserved amount n1*a* at the end point of the first weft insertion cycle is n1*a*=3.25 (turns). It is to be noted that the base reserved amount can be set to an arbitrary value higher than 1 if the amount of the yarn W by which it is wound and reserved in advance on the drums D when operation of the weaving machine is started is set to a value higher than 1. However, when a fraction of a base reserved amount is not equal to zero, since restrained flying of the last weft insertion cycle must be performed with the reserved amount n0*a* left on the drum D, such fraction is determined decisively by the location of the restraining pin P and must coincide with a fraction of the reserved amount n1*a* upon restrained flying of the first weft insertion cycle.

Other Embodiments

Figure 8:
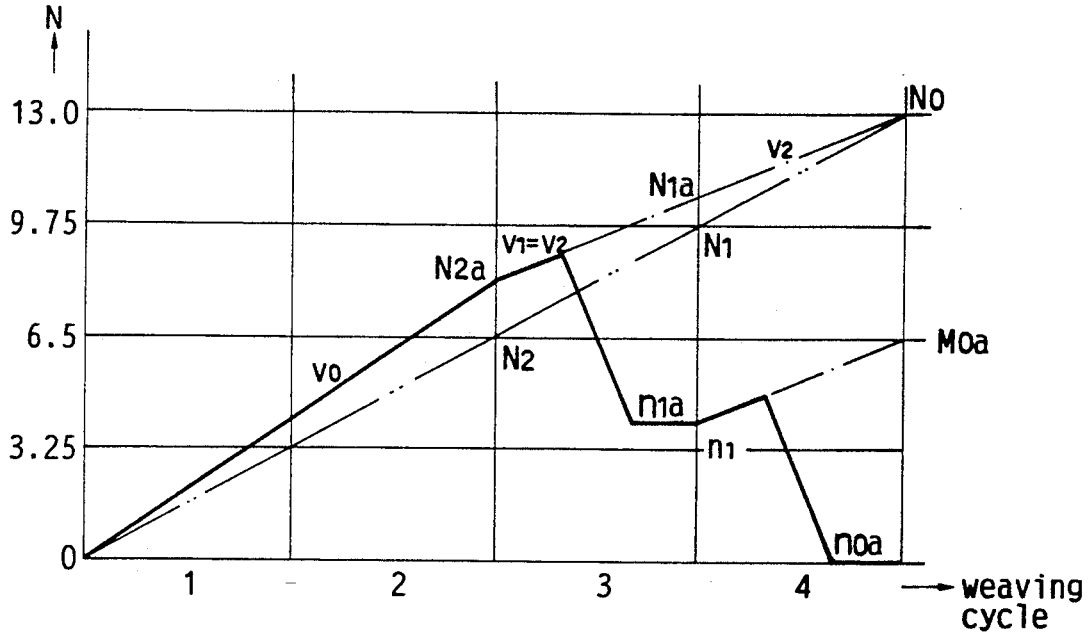

The driving speed v1 of the drum in the first weft insertion cycle can be set to v1=v2 and the driving speed v2 in the last weft insertion cycle can be used as it is as shown in FIG. 8. However, FIG. 8 shows that of the case wherein it is presumed that the location of the restraining pin P with respect to the yarn guide G is the same in the circumferential direction of the drum D and the optimum reserved amount n1*a* proximate to the theoretical reserved amount n1=3.25 (turns) at the end point of the first weft insertion cycle is determined as n1*a*=4.0 (turns). Since the driving speeds v1 and v2 do not vary for different weft insertion cycles, the dispersion of the tensile force of a yarn W during weft insertion can be made small.

It is to be noted that, if the reserved amount curve of FIG. 8 is moved upwardly in parallel to set a suitable base reserved amount, then the dispersion of the tensile force of the yarn W can be further reduced because the reserved amount n0*a* on the drum D is n0*a*≠0 also upon restrained flying in the last weft insertion cycle.

Figure 9A:
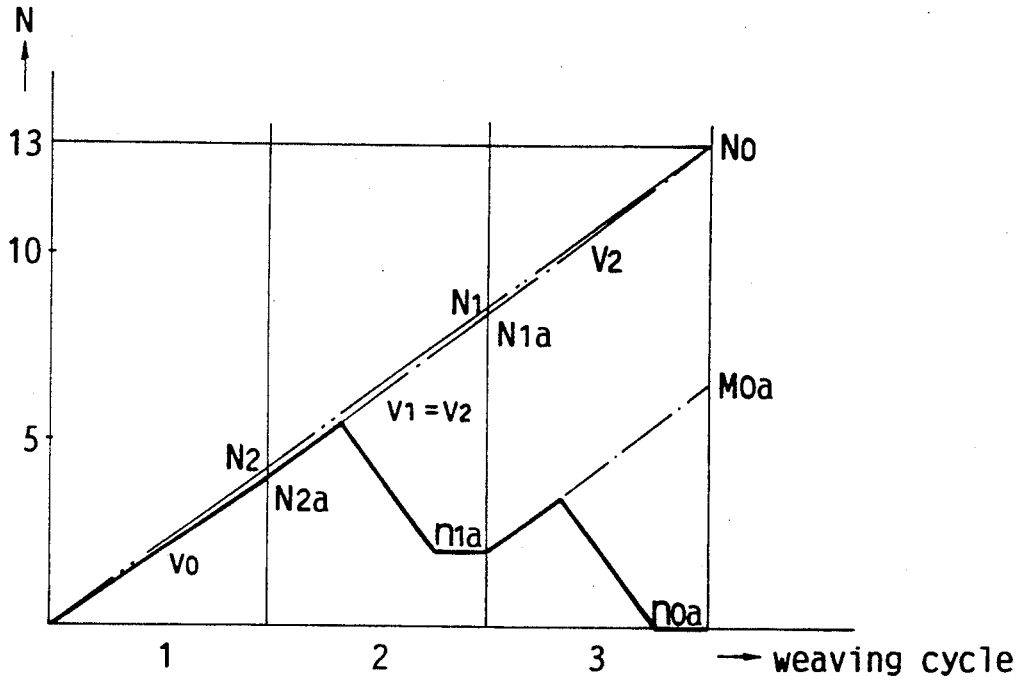
Figure 9B:
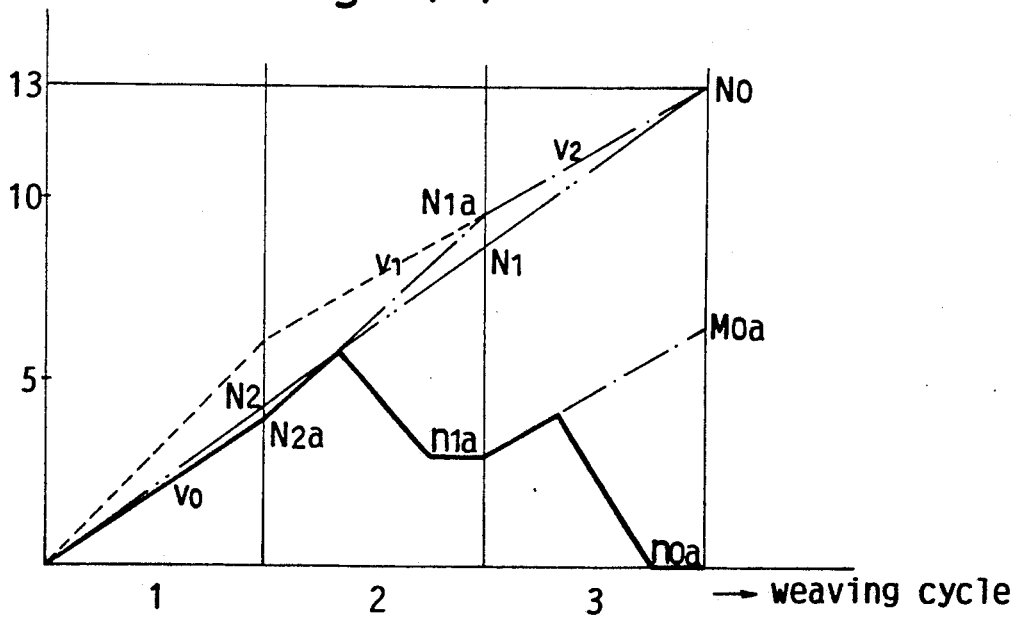

Such construction as described above can be applied also to a 2×1 weft insertion pattern wherein three weaving cycles make one repeat and the latter two weft insertion cycles of them are determined as weft insertion cycles as shown in FIGS. 9(A) and 9(B). FIG. 9(A) shows a case wherein the optimum reserved amount n1*a* at the end point of the first weft insertion cycle is set to n1*a*=2.0 (turns) while FIG. 9(B) shows another case wherein the optimum reserved amount n1*a* is set to n1*a*=3.0 (turns). The optimum reserved amount N2*a* at the starting point of the first weft insertion cycle is N2*a*=4.0 in either case.

Since v1=v2 in FIG. 9(A), a same result is obtained whether the driving speeds v1 and v2 are determined independently for different weft insertion cycles or the driving speed v2 in the last weft insertion cycle is applied as it is to the driving speed v1 for the first weft insertion cycle. However, in the case of FIG. 9(B), if the driving speed v2 is applied as it is to the driving speed v1, the reserved amount curve then is displaced to a great extent from that when the drum D is driven at an equal speed (broken line in FIG. 9(B)). Since such displacement signifies that the range of variation in speed of the drum D and the feed motor M must be made great, it is not advantageous with regard to responsibility.

It is to be noted that, in the case of FIGS. 9(A) or 9(B), the other length measuring apparatus must only drive the drum D at an equal speed so that a yarn W of a one-pick length may be reserved for one repeat because only one of three weaving cycles of one repeat is a weft insertion cycle.

Figure 10:
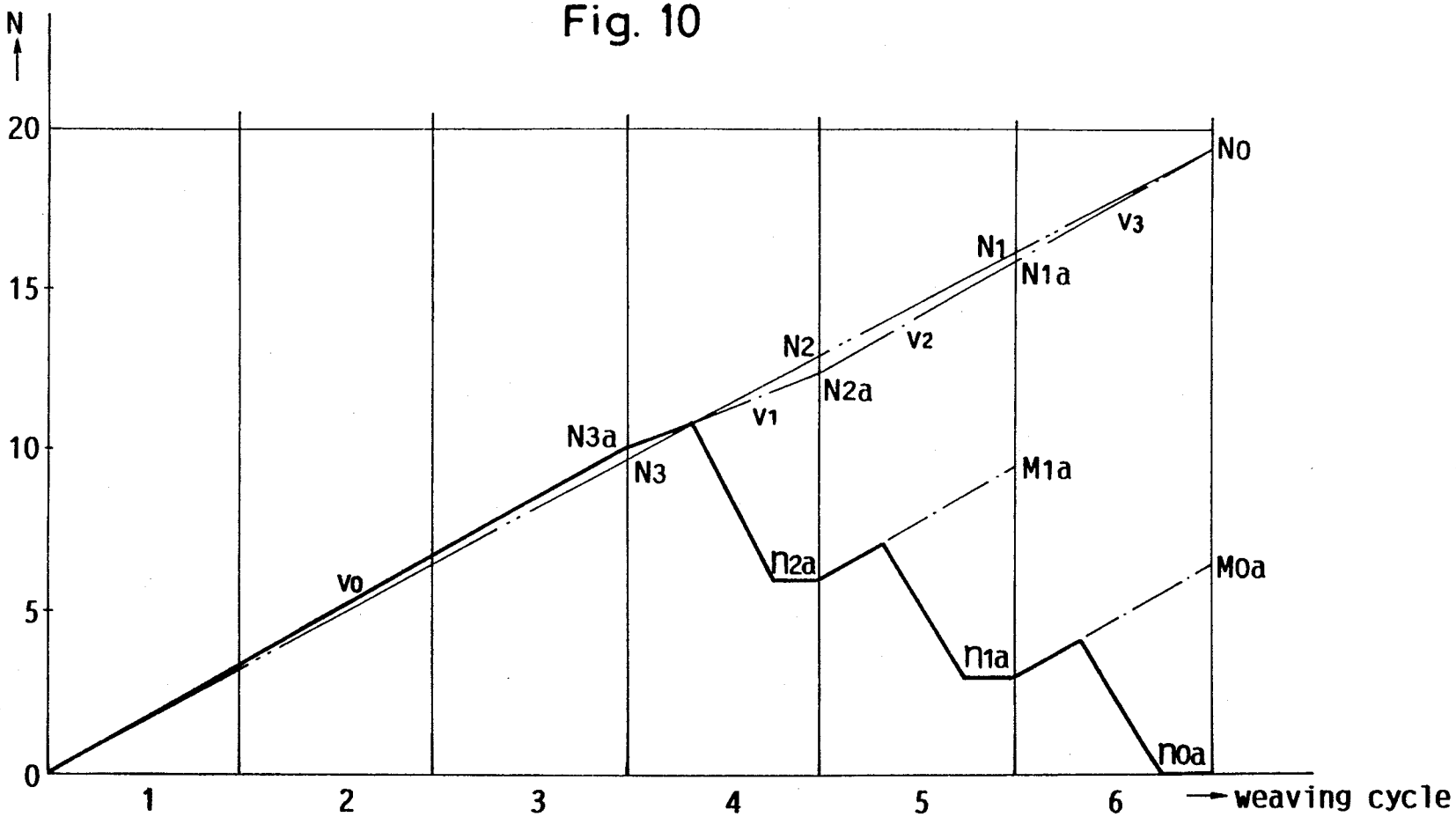

Such construction as described so far can be applied to a weft insertion pattern wherein the latter three weaving cycles among six weaving cycles are determined as weft insertion cycles as shown in FIG. 10.

Here, $N0=3_{\Delta}n=3\times6.5=19.5$ (turns) is determined, and $$N1=N0\times5/6=16.25 \text{ (turns)},$$

$$n1a=3.0\doteq N1-2_{\Delta}n=16.25-2\times6.5=3.25 \text{ (turns)},$$

$$N1a=n1a+2_{\Delta}n=3.0+2\times6.5=16.0 \text{ (turns)},$$

and $$v3=(N0-N1a)/t=(19.5-16)/t=3.5/t \text{ (turn/second)}$$

are obtained to determine the driving speed v3 in the last weft insertion cycle. Then, $n2=N0\times4/6=13$ (turns) and $n2a=6.0\doteq N2-\Delta n=13-6.5=6.5$ (turns), $$N2a=n2a+\Delta n=6.0+6.5=12.5 \text{ (turns), and}$$

$$v2=(N1a-N2a)/t=(16-12.5)/t=3.5/t \text{ (turn/second)}=v3$$

are obtained to determine the driving speed v2 in the mid weft insertion cycle, and further $$N3a=10\doteq N3=N0\times3/6=9.75 \text{ (turns), and}$$

$$v1=(N2a-N3a)/t=(12.5-10)/t=2.5 \text{ (turn/second)}$$

are obtained to determine the driving speed v1 in the first weft insertion cycle.

Optimum reserved amounts n2*a*, n1*a* and n0*a* at the end points of the weft insertion cycles are n2*a*=6.0 (turns),
n1*a*=3.0 (turns), and
n0*a*=0 (turn)

and the restraining pin P may be located at the same position as the yarn guide G1. Further, the driving speed v0 in a weft non-insertion cycle may be $$v0=N3a/(3t)=10/(3t) \text{ (turn/second)}$$

It is to be noted that, if N3*a* is set to N3*a*=9.0 (turns) in the present embodiment, then $v1=v2=v3=3.5/t$ (turn/sec) can be realized, and naturally, v0 is v0=9/(3t) (turn/second).

Similarly, the present invention can cope with weft insertion patterns of arbitrary weft insertion conditions including a case wherein the one-pick length $\Delta$n is different.

Such construction can be generalized in the following manner.

In particular, imaginary reserved amounts N0, N1*a*, N2*a*, . . . at the end points of individual weft insertion cycles have values obtained by addition of optimum reserved amounts n0*a*, n1*a*, n2*a*, . . . at the same point of time to a weft insertion length x$\Delta$n until the end point of the pertaining weft insertion cycle where x is a number of weft insertion times till the end point of the pertaining weft insertion cycle in one repeat. Further, the optimum reserved amounts n0*a*, n1*a*, n2*a*, . . . can assume either arbitrary values not equal to zero and having fractions which depend upon the location of the restraining pin P or a value equal to zero, and so far as the reserved amount curve pass the imaginary reserved amounts N0*a*, N1*a*, N2*a*, . . . at the end points at the individual weft insertion cycles determined in this manner, the drum D can be driven at an arbitrary fixed speed or at a non-fixed or variable driving speed. This is because the reserved amount curve may have any shape so long as a yarn W which is reserved on the drum D by such imaginary reserved amounts N0, N1*a*, N2*a*, . . . when weft insertion is not performed is weft inserted by the one-pick length $\Delta$n in each weft insertion cycle and consequently it is weft inserted by a predetermined weft insertion length x$\Delta$n so that it is decreased to the optimum reserved amount n0*a*, n1*a*, n2*a*. . . at the end of the pertaining weft insertion cycle.

In the meantime, in each of the embodiments described above, the optimum reserved amounts n1*a* and n2*a* at the ends of the weft insertion cycles other than the last weft insertion cycle are set to values proximate to the theoretical reserved amounts n1 and n2 and besides the driving speeds v1, v2, . . . of the drum in the individual weft insertion cycles are made constant, and accordingly, the reserved amount curves are polygonal lines which are bent between each adjacent weft insertion cycles. Further, in order to perform this, optimum reserved amounts N2*a* and N3*a* proximate to the theoretical reserved amounts N2 and N3 are determined also at the starting point of the first weft insertion cycle. In this instance, since a reserved amount curve obtained is such that the displacement thereof from a reserved amount linear line (alternate long and two short dashes line in each figure) when equal speed driving is performed for entire one repeat is very small and the range of speed variation of the drum D can be restricted to a very low level, there is an advantage that a good responsibility of the feed motor M and the drum D can be realized readily.

Further, the construction described above can be applied as it is also to a case wherein two or more discontinuous weft insertion cycles are included in one repeat. In this instance, however, it is practical that the optimum reserved amount at the end point of any weft insertion cycle which is not followed by another weft insertion cycle is set either to a base reserved amount not equal to zero or to a value equal to zero while the maximum reserved amount at the end point of any weft insertion cycle which is followed by another weft insertion cycle is set to such a base reserved amount not equal to zero that is proximate to a theoretical reserved amount.

Figure 11:
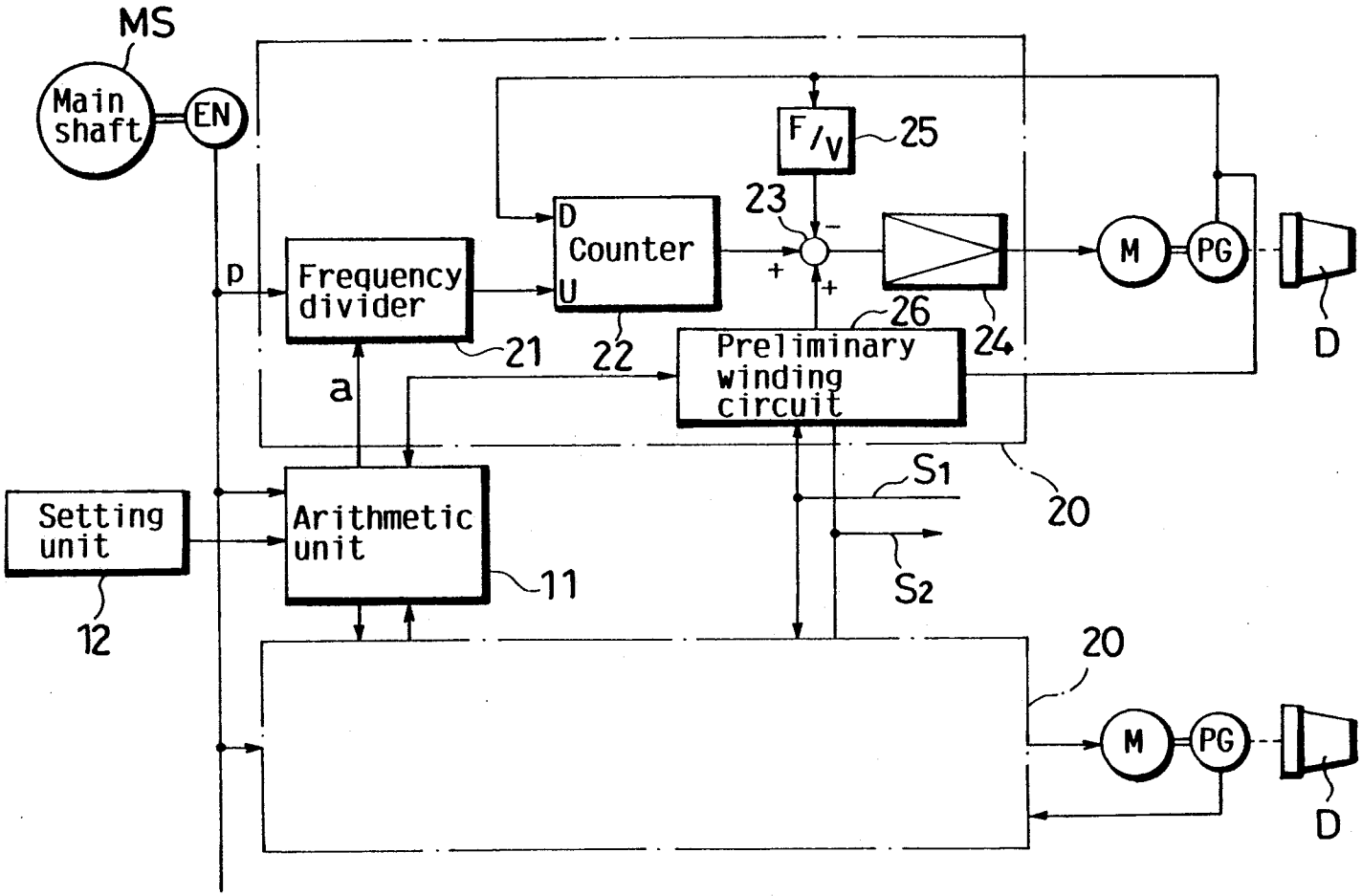
FIG. 11 is an electric system diagram showing an example of controlling apparatus to which a method of the present invention is applied.
Figure 12:
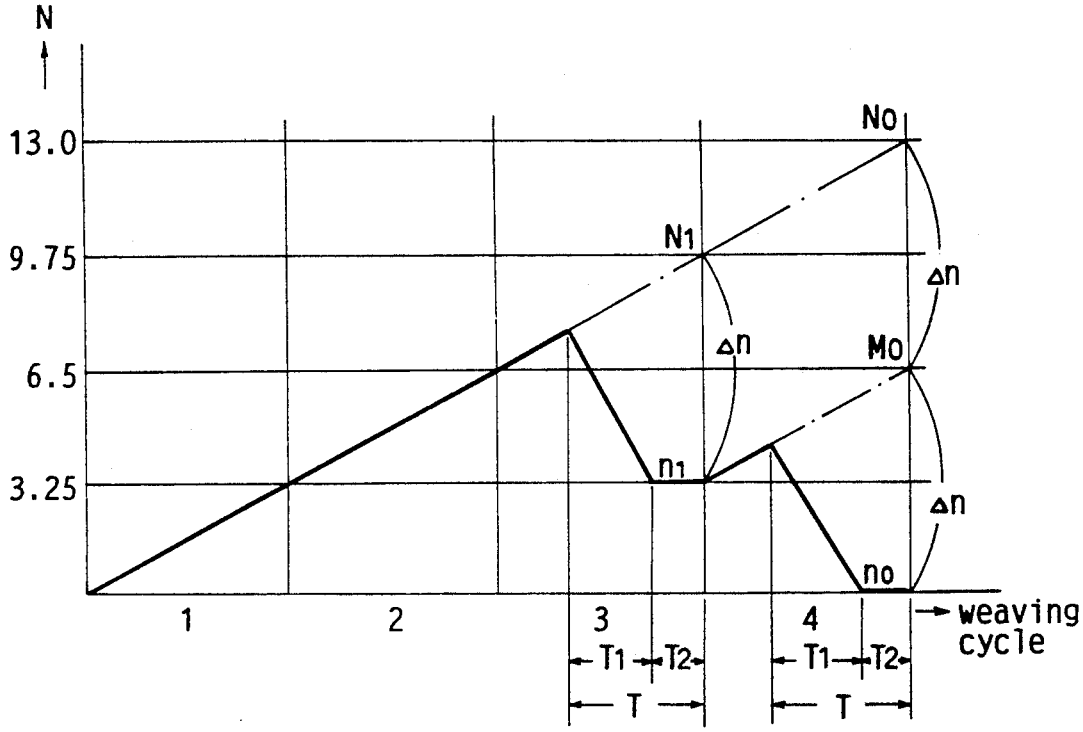
Fig. 12 (Prior Art)
FIG. 12 is a graph showing a reserved amount curve according to a conventional method.
Figure 13A:
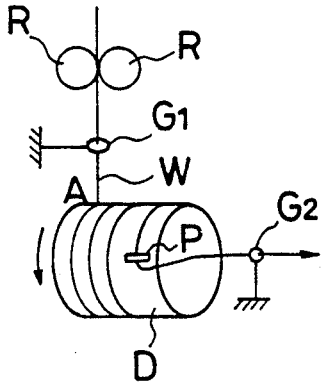
Fig. 13(A) (Prior Art)
FIGS. 13(A) and 13(B) are schematic illustrations showing restrained flying conditions.
Figure 13B:
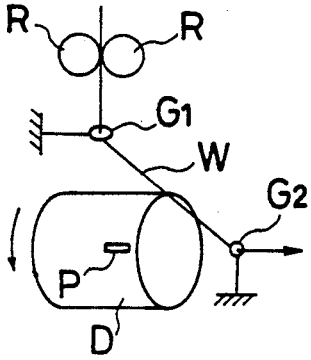
Fig. 13(B) (Prior Art)

Any of the embodiments described so far can be performed by a combination of a common arithmetic unit 11 and a pair of controllers 20 for controlling driving of the feed motors M of the individual length measuring apparatus shown in FIG. 11.

A setting unit 12 for setting weft insertion conditions is provided for the arithmetic unit 11. Further, an encoder EN is provided for a main shaft MS not shown of the weaving machine, and an output of the encoder EN is inputted to the arithmetic unit 11 and the controllers 20.

Each of the controllers 20 includes a frequency divider 21, a counter 22 and a driving amplifier 24, and outputs of the encoder EN and the arithmetic units 11 are connected to the frequency divider 21. An output of the frequency divider 21 is connected to an addition terminal U of the counter 22, and an output of the counter 22 is connected to the feed motor M of the corresponding length measuring apparatus by way of an adding point 23 and the driving amplifier 24. An output of the pulse generator PG connected to the feed motor M is negative feedback connected to the adding point 23 by way of an FV converter 25 and also to a subtraction terminal D of the counter 22.

A preliminary winding circuit 26 is included in the controller 20. The preliminary winding circuit 26 exchanges a starting preparing signal S1 and a preliminary winding completion signal S2 between a weaving machine controlling circuit not shown, and a bidirectional signal route is formed also between the preliminary winding circuit 26 and the arithmetic unit 11. An output of the pulse generator PG is inputted to the preliminary winding circuit 26, and an output of the preliminary winding circuit 26 is connected to the adding point 23.

Prior to starting of the weaving machine, weft insertion conditions such as a weft insertion pattern, a location of the restraining pin P, a weaving width, a diameter of the drums D and a base reserved amount will be set by way of the setting unit 12, and such data are transferred as they are to the arithmetic unit 11. However, fixed data such as the location of the restraining pin P and a diameter of the drums D may otherwise be stored in advance in either one of the setting unit 12 and the arithmetic unit 11.

The arithmetic unit 11 decodes such weft insertion conditions provided thereto by way of the setting unit 12, calculates a reserved amount curve for one repeat in accordance with the procedure described above for each length measuring apparatus, and calculates, for each weaving cycle in the one repeat, imaginary reserved amounts Nia and Nja at the starting point and the end point and an optimum reserved amount nia at the end point of the weaving cycle, where i=0, 1. . . . and j=i−1. Further, it is assumed that N0*a* represents an imaginary reserved amount N0 at the end point of the last weft insertion cycle, and imaginary reserved amounts at the starting point and the end point of each weft non-insertion cycle should be determined for each weft non-insertion cycle proportionately distributing the reserved amount curve on the assumption that the drum D is driven at an equal speed from the starting point of the first weft non-insertion cycle to the end of the last weft non-insertion cycle. Further, the unit of the imaginary reserved amounts Nia and Nja is a number of turns of the drum D, and such number can be calculated readily by calculating, using the diameter of the drums D and the weaving width, a one-pick length $_{\Delta}$n represented by a unit of turns of the drums D.

Subsequently, the arithmetic unit 11 calculates a preliminary winding amount before starting for each length measuring apparatus and outputs the same to the preliminary winding circuits 26 of the controllers 20 of the length measuring apparatus. Such preliminary winding amount can be determined from a reserved amount curve as a reserved amount to be reserved in advance in the length measuring apparatus depending upon to which weaving cycle the weaving cycle corresponds in one repeat. Each of the preliminary winding circuits 26 outputs, in response to a starting preparing signal S1 from the weaving machine controlling circuit, the thus received preliminary winding amount to the adding point 23 to drive the feed motor M to rotate by a predetermined rotational amount so that such reservation can be performed on the drum D.

Completion of such preliminary winding operation is transmitted as a preliminary winding completion signal S2 from the preliminary winding circuit 26 to the weaving machine controlling circuit. Further, completion of such preliminary winding operation is communicated also to the arithmetic unit 11. Thus, the arithmetic unit 11 outputs a frequency division ratio a for a weaving cycle immediately after starting to the frequency dividers 21 of the controllers 20 for the individual length measuring apparatus, and after then, it waits until it operates in response to an output of the encoder EN. In particular, if a number p of pulses are outputted for each weaving cycle from the encoder EN and the length measuring apparatus should drive the drum D so that it may perform an increase of the imaginary reserved amount of $_{\Delta}$N=Nja−Nia in a particular weaving cycle, then the arithmetic unit 11 can determine the frequency division ratio a then as a=$_{\Delta}$N/p.

After starting of the weaving machine, pulses are outputted successively from the encoder EN in response to rotation of the main shaft MS, and consequently, the frequency divider 21 frequency divides such pulses using the frequency division ratio a given thereto and outputs the same to the counter 22. Since an output of the counter 22 is connected to the feed motor M by way of the driving amplifier 24 and amounts of rotation of the feed motor M and the drum D are fed back as an output of the pulse generator PG to the counter 22, the drum D can be driven so that the imaginary reserved amount Nia at the starting point of the weaving cycle may be increased to the imaginary reserved amount Nja at the end point. The driving speed v of the drum D then is equal to $v=(Nja-Nia)/t$ described hereinabove when the weaving machine is operated at a fixed speed. However, when the weaving machine is at a starting step or a stopping step and the operating speed thereof is varying, the driving speed v follows such operating speed of the weaving machine. It is to be noted that the FV converter 25 forms a speed negative feedback system for the feed motor M to improve the responsibility of the feed motor M.

As described so far, according to the present invention, since the weft insertion controlling method can cope with any weft insertion condition with the location of a restraining pin left fixed with respect to a drum by driving the drum at various speeds for individual weft insertion cycles in one repeat, it has an excellent effect that the operation in working can be simplified remarkably.

What is claimed is:

1. A method for driving a weft reserving device to perform a repeating weft insertion pattern comprising a sequence of weft insertion cycles and non-insertion cycles, said method comprising the steps of:

feeding a length of weft to a rotatably drum from delivery rollers at a weft feeding speed;

rotating said rotary drum with a peripheral speed approximately equal to said weft feeding speed to wrap said weft on said delivery drum;

sucking weft from an end of said drum in a free flying condition into a weft inserting nozzle while continuing to feed weft to said drum at said weft feeding speed;

engaging a restraining pin with said weft at the end of at least a first weft insertion cycle, thereby causing a restrained flying of the weft during which weft is fed into said weft inserting nozzle at said weft feeding speed and during which weft is fed to the drum from the delivery rollers at said weft feeding speed;

maintaining an optimum amount of weft on said drum with said restraining pin during said restrained flying; and controlling said weft feeding speed such that a fixed pick length of weft is supplied to said insertion nozzle during each weft insertion cycle, the speed compensating for the optimum reserved amount of weft which is retained on the drum by the restraining pin at the end of each insertion cycle.

2. A method according to claim 1, wherein a driving speed of said drum in a last weft insertion cycle of said repeating weft insertion pattern is applied to another weft insertion cycle.

3. A method according to claim 1 or 2, wherein said optimum reserved amount is greater than zero and depends upon the location of said restraining pin.

4. A method according to claim 1, wherein said optimum reserved amount is zero or an amount determined by a whole number of turns of said drum.

* * * * *